US007621650B2

(12) United States Patent
Nalitchaev et al.

(10) Patent No.: US 7,621,650 B2
(45) Date of Patent: Nov. 24, 2009

(54) LIGHT TOWER, LIGHT TOWER SUPPORT, METHOD FOR OPERATING A LIGHT TOWER AND A LIGHT TOWER CONTROL UNIT FOR CARRYING OUT SAID METHOD

(76) Inventors: Boris Vladimirovitch Nalitchaev, ul. Palehskaya 143, kv. 16, Moscow (RU) 129347; Ilia Borisovich Nalitchaev, ul. Palehskaya 143, kv. 16, Moscow (RU) 129347

( * ) Notice: Subject to any disclaimer, the term of this patent is extended or adjusted under 35 U.S.C. 154(b) by 161 days.

(21) Appl. No.: 11/665,916

(22) PCT Filed: Sep. 13, 2005

(86) PCT No.: PCT/RU2005/000463

§ 371 (c)(1),
(2), (4) Date: Apr. 20, 2007

(87) PCT Pub. No.: WO2006/049530

PCT Pub. Date: May 11, 2006

(65) Prior Publication Data

US 2008/0106888 A1 May 8, 2008

(30) Foreign Application Priority Data

Nov. 3, 2004 (RU) ..... 2004132067

(51) Int. Cl.
*F21V 33/00* (2006.01)

(52) U.S. Cl. ..... 362/96; 362/189; 362/352; 362/363; 446/226

(58) Field of Classification Search ..... 362/96, 362/385, 352, 253, 189, 363; 446/220, 226
See application file for complete search history.

(56) References Cited

U.S. PATENT DOCUMENTS

| | | | | |
|---|---|---|---|---|
| 4,179,832 | A * | 12/1979 | Lemelson | 40/540 |
| 6,186,857 | B1 * | 2/2001 | Gazit et al. | 446/226 |
| 6,322,230 | B1 | 11/2001 | Medici | |
| 6,644,843 | B2 * | 11/2003 | Chin-Cheng | 362/97 |
| 6,966,676 | B2 * | 11/2005 | Chabert et al. | 362/363 |
| 7,198,538 | B2 * | 4/2007 | Chin-Cheng | 446/220 |
| 7,216,446 | B2 * | 5/2007 | Machala | 40/610 |

FOREIGN PATENT DOCUMENTS

| | | |
|---|---|---|
| FR | 2736706 | 7/1995 |
| RU | 2188981 | 8/1999 |
| RU | 2192581 | 11/2002 |
| SU | 1203470 | 8/1984 |

* cited by examiner

*Primary Examiner*—Thomas M Sember
(74) *Attorney, Agent, or Firm*—Aleksandr Smushkowich

(57) ABSTRACT

The invention relates to outdoor lighting devices used mainly in emergency situations. The inventive light tower comprises an inflatable mast, including a flexible transparent shell, fixed to a support flange provided with an air intake vent for pumping compressed air into a shell chamber, an electric lamp fixed in the shell, an air pump driven with a motor, a working chamber connected to the vent, and power supply means substantially connected to the lamp and in some embodiments to the pump. The shell is divided into a lower and upper parts joined with an airtight coupling means. The mast is furnished with means for changing the length associated with the upper part. A control unit for the light tower and power means are mounted on the flange. The air supply into the shell chamber is manually/automatically adjustable. In several embodiments light reflectors and inflate modes are described.

20 Claims, 9 Drawing Sheets

47
98
99
96

7
4
47
13
1
3
96
34
34
83
9
10
82
8
95
86
90
85
91
92
89
88
72
104
84
94
93
87
101
103
44
100
97
102
43
34

LIGHT TOWER, LIGHT TOWER SUPPORT, METHOD FOR OPERATING A LIGHT TOWER AND A LIGHT TOWER CONTROL UNIT FOR CARRYING OUT SAID METHOD

CROSS-REFERENCE TO RELATED APPLICATIONS

This application is a U.S. national phase application of a PCT application PCT/RU2005/000463 filed on 13 Sep. 2005, published as WO2006049530, whose disclosure is incorporated herein in its entirety by reference, which PCT application claims priority of a Russian Federation patent application RU2004132067 filed on 3 Nov. 2004.

FIELD OF THE INVENTION

This invention relates to outdoor illumination devices, used primarily in emergency situations. The invention is intended for use in the nighttime at emergency sites requiring restoration, for rescue operations, for repair work in extreme conditions, or for routine repair and construction work in the nighttime, for example on railroads.

BACKGROUND OF THE INVENTION

There are known devices (of comparatively complex design) for illuminating territories in emergency situations. Each of them consists of an air- or helium-inflatable transparent flexible shell with a light source (typically a lamp) located within the shell, means for supplying air into the shell, means for supplying electricity to the lamp, a control unit, means for protecting the shell from heat damage when it comes into contact with the lamp; such a protective device is made of protective elements surrounding the lamp and located within the shell together with the lamp [1-11].

There are known mobile installations for illuminating territories primarily in emergency situations. Each of these consists of a transport vehicle on which the lighting installation is mounted, including a thin and flexible air- or helium inflated transparent shell with a light source (typically a lamp) inside it, means for supplying air into the shell, means for supplying electricity to the lamp, a control unit, and means for protecting the shell from heat damage when it comes into contact with the lamp [12-14]. These devices have comparatively complex design.

There is a known emergency lighting installation, which consists of a tower serving as a mast for electric lamps, which mast is made of an upwardly-elongated flexible and transparent airtight shell whose bottom end is hermetically fitted onto a flange with an air vent for inflating the air chamber of the shell with air under pressure; the electric lamps located inside the shell; a stand connected with the flange; a motor-driven air pump connected with the air vent of the flange; and means for supplying electricity from a power source to the electric lamp. The lamp is encased in a protective cage, which is secured to the wall of the shell with suspension wires [15].

A major shortcoming of the technical solution for the emergency lighting installation [15] is the fact that the shell of the installation [15] is designed with an undoable zip fastener and insert that adjust the shell height. Inclusion of an undoable zip fastener and insert, which adjust the height of the installation, in the arrangement of the utility model [15] is technically unfeasible because the structure of the undoable zip fastener and insert has not been defined. At the same time, the wording "shell with an undoable zip fastener and insert for adjusting its height" implies that the insert may be adjustable. The means of adjusting the height of such an insert are not specified. In essence, in the form in which it is presented, the utility model [15] provides no means for adjusting the height of the inflatable shell that forms the light tower mast.

Furthermore, if the inflatable shell of the mast has an undoable zip fastener, tests have shown that air will leak into the atmosphere through the zip fastener, making the mast unusable. Air leaks through the zip fastener will cause loss of pressure in the mast, causing it to shrink and collapse. This circumstance points to the unfeasibility of the technical solution [15]. For the above mentioned reasons of unfeasibility of the utility model, this technical solution does not meet the criterion of industrial applicability. The technical solution that is closest in terms of its essence and technical effect to the technical solution described in this invention is a light tower consisting of a mast made of an upwardly-elongated flexible and transparent airtight shell whose bottom end is hermetically fitted onto a flange with an air vent for inflating the air chamber of the shell with air under pressure, at least one electric lamp located inside the shell, a stand connected with the flange, a motor-driven air pump connected with the air vent of the flange, and a means for supplying electricity from a power source to the electric lamp [16].

In terms of its arrangement solution, this light tower does not fully meet the requirements in terms of manufacturability, operational reliability, ease of maintenance, and conditions for its modification in cases where different types of motors or power sources will be used in the arrangement, for example, electric motors or internal combustion engines, or power supplied from the electricity mains line, rechargeable batteries, or a generator connected to the motor or a stationary generator mounted on the motor.

Also known is a light tower mast made of an upwardly-elongated flexible and transparent airtight shell whose bottom end is hermetically fitted onto a flange with an air vent for inflating the air chamber of the shell with air under pressure [16].

A shortcoming of this light tower mast is that it is difficult to access the chamber of the shell in which the electric lamp is encased. Another shortcoming of the mast is that it is impossible to raise or lower it, which limits application of the light tower, for example, in case of ceiling limitations or, conversely, when it is necessary to raise the mast in order to illuminate a larger area.

Also known is a light tower mast made of an upwardly-elongated flexible and transparent airtight shell whose bottom and top ends are hermetically fitted onto the top and bottom flanges. The bottom flange has an air vent for inflating the air chamber of the shell with air under pressure. The top flange has a holder for the electric lamp. The mast is also equipped with a top light reflector [17].

A shortcoming of this light tower mast is its unsatisfactory light reflection capability and the complexity of its design.

A known method of controlling the operation of the light tower involves supplying air under pressure into the air chamber of the mast shell [16].

In this technical solution air is pumped into the shell at a constant rate and under constant pressure while the mast shell expands (is installed in the vertical position) and while it is being used. Pumping up the shell requires excessive air pressure in order to quickly and reliably install the mast in the vertical position. Meanwhile, experience of using light towers shows that excessive pressure in the shell causes intensifying air leaks from the shell through its seams, micro ruptures and premature wear. This also reduces the service life of the motor that drives the air pump.

A known unit controlling the operation of an inflatable illuminating shell includes a connection with a power source, an electric circuit controlling the operation of a light tower electric lamp, and an electric circuit controlling the operation of a motor driving an air pump that inflates a air chamber of a tower mast [3].

This control unit does not have a means for adjusting the rate of air supply into the inflatable illuminating shell of the lighting device, which reduces its operational reliability.

BRIEF SUMMARY OF THE INVENTION

A feasible objective of this invention is to expand the functional capabilities of the light tower and increase its operational reliability.

This technical objective is accomplished by mounting a motor-driven air pump, control unit and means for supplying electricity, onto a flange of a light tower. The light tower comprises a mast made of an upwardly-elongated flexible and transparent airtight shell whose bottom end is hermetically fitted onto the flange with an air vent for inflating the shell with air under pressure, at least one electric lamp located inside the shell, a stand connected with the flange, a motor-driven air pump connected with the air vent of the flange, and a means for supplying electricity from a power source to the electric lamp.

A first variation of the inventive light tower mast has several arrangements with regard to the type of power supply and disposition of the air pump, motor, and control unit, which are disclosed herein as follows.

The air pump, motor, and control unit are located on top of the flange inside the mast shell. The electricity supply unit is located on the outside of the flange in its lower section. The motor driving the air pump is electrical. The electricity supply unit is connected to a remote power source, for example, to the electricity mains line.

The air pump, motor, and control unit are located on top of the flange inside the mast shell. The electricity supply unit is located on the outside of the flange in its lower section. The motor driving the air pump is electrical. The electricity supply unit is connected to an autonomous power source, for example, a rechargeable battery mounted on the tower stand.

The air pump, motor, control unit, and electricity supply unit are mounted on the outside of the flange in its lower section. The pump motor is electrical. The electricity supply unit is connected to a remote power source, such as the electricity mains line.

The air pump, motor, control unit, and electricity supply unit are mounted on the outside of the flange in its lower section. The pump motor is electrical. The electricity supply unit is connected to an autonomous power source, for example, a rechargeable battery, mounted on the tower stand.

The air pump, motor, control unit, and electricity supply unit are mounted on the outside of the flange in its lower section outside the mast shell. The pump is driven by an internal combustion engine coupled with an autonomous power source such as a generator, which is connected to the electricity supply unit powering the lamp.

The air pump, motor, control unit, and electricity supply unit are mounted on the outside of the flange in its lower section outside the mast shell. The pump is driven by an internal combustion engine. The electricity supply unit is connected to an autonomous power source, for example, a rechargeable battery mounted on the tower stand.

The technical objective is also accomplished by a light tower mast made of an upwardly-elongated flexible and transparent airtight shell whose bottom end is hermetically fitted onto a flange with an air vent for inflating the shell with air under pressure—along its perimeter The bottom end of the mast shell is made of two coupling-linked lower and upper sections. The connecting sections of the mast shell are linked by an airtight detachable coupling with a pressure seal; the lower section is linked to the flange. The upper section of the shell includes a rapid-action refractor That is fitted onto the outside of the upper section of the mast shell that is attached to the outer surface of the shell.

The retractor of the upper section of the mast shell comprises two connected counterparts of a rapid-action lock, which extend to both ends of the mast shell. When the mast shell is extended or collapsed, the counterparts of the rapid-action refractor intersect and are connected in one point on the outer surface of the shell. When the upper section of the shell is extended, each counterpart of the retractor is connected to the outer surface of the shell along a spiral line that moves away from aforesaid intersection point. When the upper section of the shell is collapsed, the counterparts of the rapid-action retractor are aligned along their entire length.

The hermetic detachable coupling is made of a rapid-action airtight lock, and a sealing appliance made as a single whole with the lock. The sealing appliance of the detachable lock coupling comprises a diaphragm that seals the lock coupling.

The diaphragm is located inside the mast shell. At least two different designs of the diagram may be deployed, as follows. The diaphragm is made of an additional flexible airtight shell. Its external surface comes into contact with the internal surface of the upper and lower sections of the mast shell. The lower end of the additional shell is hermetically coupled to the flange around the air vent. At the free end of the additional shell is a neck whose cross-section has a smaller area than the cross-section of the mast shell. The diaphragm is made of two flexible elements located inside the mast shell along its perimeter on both sides of the lock coupling. The two elements overlap.

Also, the technical objective is accomplished by means of a second variation of the light tower mast, which is made of an upwardly-elongated flexible and transparent airtight shell whose bottom and top ends are hermetically fitted onto the top and bottom flanges. The bottom flange has an air vent for inflating the shell with air under pressure. The top flange has a holder for the electric lamp. The mast is also equipped with a top light reflector. Inside the mast shell there are at least two additional directional light reflectors, one of which is located at the bottom of the mast, and the other on one side of the mast. At the same time, the bottom and top light reflectors are directed at the side reflector, which is in turn directed at the remote object of illumination.

The light reflectors are formed as light-reflecting coatings, one of which covers the inside of the mast shell along one of its sides, forming the side light reflector, while the two other light-reflecting surfaces are located on the inside top and bottom surfaces of the mast shell.

Light-reflecting coatings cover the inside surfaces of the top and bottom spherical flanges, which are located inside the mast shell.

The technical objective is also accomplished through using a method of light tower operation control, which involves inflation of the mast shell with air under pressure. Initially, air is pumped into the mast shell in large quantities and under high pressure. Once the light tower mast has been installed in the vertical position, the volume and pressure of air pumped into the mast shell are reduced. Air pressure in the lower section chamber of the mast shell is higher than air pressure in the upper section chamber of the mast shell.

The technical objective is also accomplished by means of a unit controlling the operation of the light tower, which includes a connection to the power source, an electric circuit controlling the operation of the light tower electric lamp, and an electric circuit controlling the operation of the motor driving the air pump that inflates the shell of the tower mast. The control unit comprises a device for manual or automatic adjustment of the motor and pump speed depending on the air pressure in the light tower mast shell.

The electric lamp control circuit comprises a first relay for switching on the electric lamp and a start-and-adjustment device connected with the lamp through the contacts of the first relay. The electric motor control circuit comprises a second relay for switching on the electric motor, a first and a second parallel-connected capacitors that are series-connected with the electric motor; a permanently closed contact of the first relay connected with the second capacitor; a button for turning on the electric motor for full-capacity operation, which is connected with the first and second capacitors; the second relay is connected with the electricity mains line via the motor power-on button and with the contacts of the second relay; the electric motor control circuit comprises a power-off and tower shutdown button, which is connected with the mains electricity line.

The device controlling the speed of the electric motor and air pump that inflates the air chamber of the mast is electronically connected with an air pressure sensor that measures air pressure in the air chamber of the light tower mast.

DESCRIPTION OF THE LIGHT TOWER VARIATIONS

Figure 1:
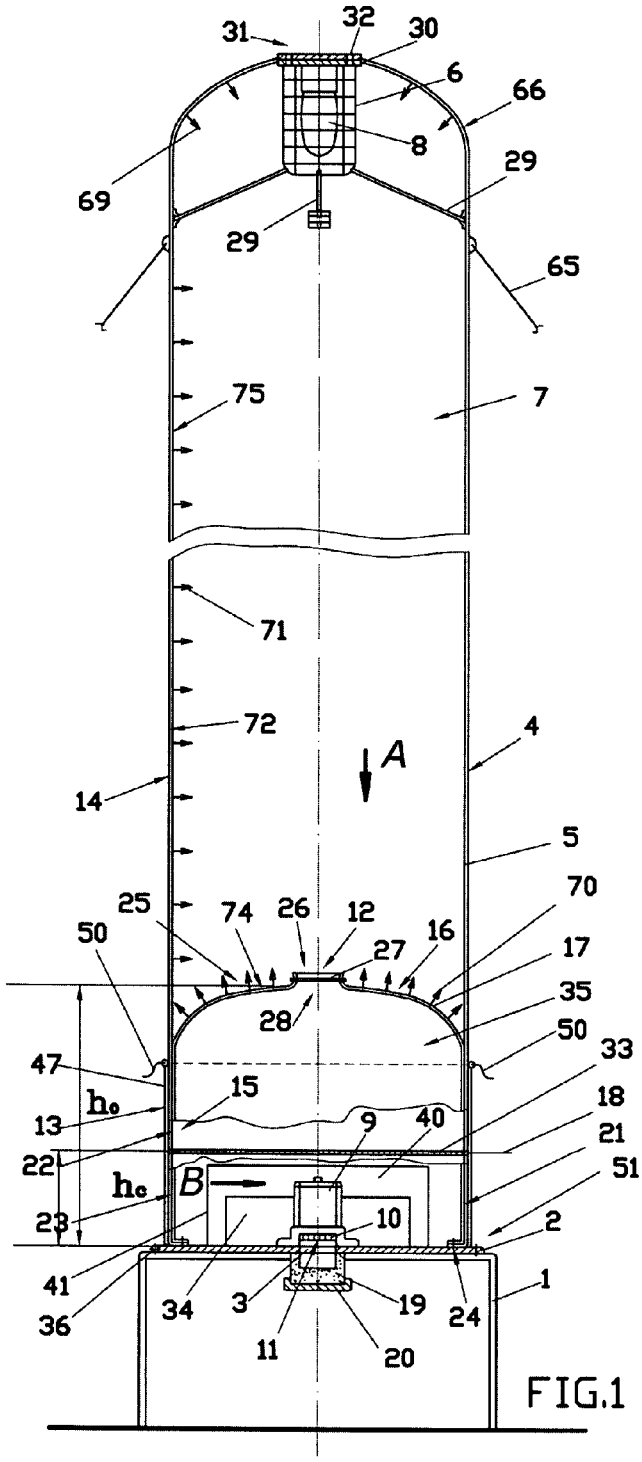
FIG. 1 is an orthogonal view that shows one of the possible technical solutions for the light tower (light tower arrangement)
Figure 2:
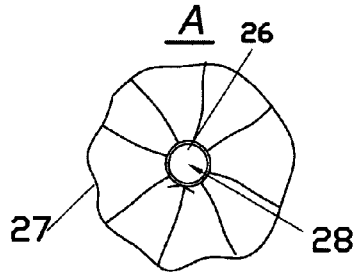
FIG. 2 is an orthogonal view that shows view A of FIG. 1.

While the invention may be susceptible to embodiment in different forms, there are shown in the drawings, and will be described in detail herein, specific embodiments of the present invention, with the understanding that the present disclosure is to be considered an exemplification of the principles of the invention, and is not intended to limit the invention to that as illustrated and described herein.

The light tower comprises a foundation (illustrated in FIG. 1), made in the form of a stand (1), and a bottom flange attached to the stand. The bottom flange is made in the form of a flat plate (2) with a rounded edge along the entire perimeter of the plate. The flange plate (2) has a central air vent hole (3).

The bottom flange comprises the plate (2) and fastening or coupling elements used for mounting tower components on the plate, described herein below.

The light tower comprises a light tower mast (4). The bottom end of the light tower mast (4) is hermetically coupled onto the plate (2). The mast (4) is performed as a thin and flexible airtight transparent shell with a continuous wall (5), which is being in an operating position when inflated with compressed air.

The light tower mast (4) serves to support at least one electric lamp (8) at a specified height. The lamp is enclosed in a protective cage (6) inside the air chamber (7) of the mast (4).

The plate (2) is attached to a motor (9), which is connected to an air pump (10) capable of inflating an air chamber (7) of the mast shell (4). To extend the spheres of application of the light tower, in different light tower arrangements the motor (9) may be electrical or may be replaced with an internal combustion engine installed on the plate (2) of the bottom flange in a variety of combinations described below.

The air pump (10) is a ventilator impeller connected with the motor (9) directly or via other components of the pump drive. The air pump (10) comprises a working chamber (11). At one end, the working chamber (11) of the air pump connects with the atmosphere through an air intake (3) of the plate (2). At the other end, the working chamber (11) of the pump connects with an air chamber (15), formed by a diaphragm (12) and, via the latter, with an air chamber (7) of the light tower mast (4). In its bottom region the mast (4) comprises a lower section (13) and it comprises an upper section (14) coupling-connected to each other.

The diaphragm (12), shown in FIG. 1 and other drawings, serves to secure an airtight coupling between the lower and upper sections (13) and (14) of the tower mast (4).

The shell of mast (4) comprises a wall (5) that is round in cross-section. The coupling of the sections (13) and (14) has a sealing means, which in one tower arrangement is performed as the aforementioned diaphragm (12) that closes the coupling of the sections (13) and (14) of the tower mast when they are linked. In one tower mast arrangement, the diaphragm (12) is located between the air chamber (15) of the lower section (13) of the tower mast (4) and the air chamber (7) of the upper section (14) of the mast (4).

The diaphragm (12) is made of an additional flexible airtight shell (16) and has a flexible wall (17) that is under pressure when being in the operating position. Its external surface comes into contact with the internal surface of the upper and lower sections (13) and (14) of the mast shell (4). The lower end of the additional shell (16) is hermetically coupled to the bottom flange plate (2) around its air vent (3).

100461 The additional shell (16) is located in the lower and upper sections (13) and (14) of the mast (4) in such a manner that, when the tower is in its working position under pressure, it closes and seals the line (18) of the coupling between the lower and upper sections (13) and (14) of the mast. At the free end of the additional shell (16) there is a neck (26) of the diaphragm (12). The area of the neck cross-section is much smaller than that of the cross-section of the internal chamber (7) of the upper section (14) of the mast (4). The neck of the diaphragm (12) is located higher than the line (18) of the coupling of the lower and upper sections (13) and (14) of the mast (4).

The mast (4) comprises at least one source of light, represented by an electric lamp (8) shown in FIG. 1 and other drawings. Through the detached coupling of these sections (13) and (14) it is possible to access the electric lamp (8) and components of the tower drive when the tower is in the collapsed position. The air filter (19) with the protective cup (20) mounted on the free end of the filter is located below the air intake (3) of the plate (2) and is attached to the intake.

The height (ho) of the additional shell (16) of the diaphragm (12) in its working position is larger than the height (hc) of the lower section (13) of the mast (4), to a sufficient extent to reliably seal the coupling of the lower and upper sections (13) and (14) of the mast (4) and ensure the required rigidity of the root lower section (13) of the tower mast when in its operating position. The additional shell (16) of the diaphragm connects with the upper and lower sections (13) and (14) of the mast (4) only when the tower is in its operating position, when the diaphragm (12) expands laterally under air pressure and presses with its outer surface (21) onto the internal surfaces (22) and (23) of the lower and upper sections (13) and (14) of the mast.

The mast comprises a lower end (24) of the additional shell (16) is rigidly and hermetically connected with the plate (2), an upper end (25) of the shell (16) that is freely positioned. Under air pressure in the shell (16), the upper end (25) extends toward the upper section (14) of the mast (4). When the tower is in use, air pressure in the additional shell (16) is always higher than the air pressure in the chamber (7) of the upper section (14) of the mast (4).

When the tower is in its collapsed position, the free end (25) of the additional shell (16) is identical to its lower end (24) along its perimeter. When the tower is in its operating position, the edge of the free end (25) of the additional shell (16) of the diaphragm (12) is gathered into the above mentioned neck (26) in the direction of the central longitudinal axis of the mast (4) and fixed with a string (27) in such a way that it forms an air outlet (28) for this neck, whose area is smaller than the area of the cross-section of the upper section (14) of the mast (4).

In the upper section (14) of the mast there are at least three suspension wires (29) that fix the cage (6) in its operating position. The suspension wires are located at equal intervals along the cage perimeter. The first end of each suspension wire (29) is connected with the bottom free end of the cage (6), and the second end of each suspension wire (29) is connected with the wall (5) of the upper section (14) of the mast (4). The second end of each suspension wire is located lower than the first end of the suspension wire. There are several possible variations of the suspension wires. They can be flexible, rigid or resilient. Resilient suspension wires (29) are placed into their operating position by first extending or collapsing them. For example, during the operation of the light tower, resilient spring-loaded suspension wires (29) are constantly extended or compressed in order to stabilize the position of the electric lamp (8) when air pressure drops in the air chamber (7) of the mast when it collapses.

Figure 22:
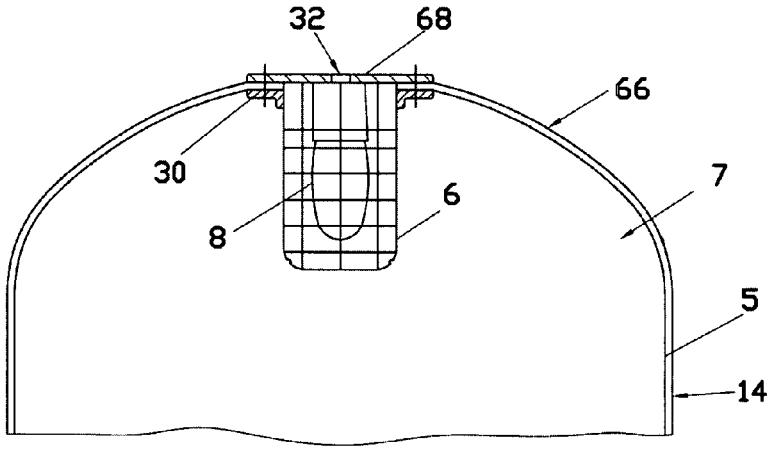
FIG. 22 is an orthogonal view that shows the upper section of the mast, a fragment of the first variation of the mast—the top flange is connected to the appliance holding the electric lamp.

The protective cage (6) is attached to a top flange (30) arranged at the top of the mast (4), and the upper end of the mast shell is hermetically coupled to the top flange. The cage (6) and electric lamp (8) are attached to a lamp holder, which includes a second flange (31) that attaches the electric lamp to the upper section (14) of the mast. The flange (31) can be mounted in the central opening of the flange (30) as shown in FIG. 22. The flange (30) has at least one air vent (32), which connects the air chamber (7) of the upper section (14) of the mast (4) with the atmosphere. Air passes through the opening (32) to cool down the electric lamp (8).

The upper and lower sections (13) and (14) of the mast (4) are connected by a rapid-action lock (33) (FIG. 1), which has been selected from among known locks. The lock (33) serves to couple the sections (13) and (14) of the mast, and its design makes it possible to include in it a sealing appliance for the coupling of the sections (13) and (14) of the mast (4). In the described light tower arrangement (FIG. 1) the coupling of the sections (13) and (14) of the mast (4) is sealed by the diaphragm (12). This particular sealing variation for this coupling does not rule out other sealing options, which are described below.

According to the description of the invention, the light tower presented in this particular arrangement makes it possible to implement several design solutions using various sources of power, different arrangements of the air pump, electric motor, or internal combustion engine. Several such arrangement solutions of the light tower are described below.

To enable control of the light tower operation, its design includes a control unit (34) for controlling its operation, which is electrical in this particular arrangement of the light tower described above. In one arrangement of the light tower, the control unit (34), motor (9), and air pump (10) are mounted inside an air chamber (35) of the diaphragm (12) and coupled onto the upper surface of the plate (2) of the top flange that links the mast (4) to the tower stand (1).

Figure 4:
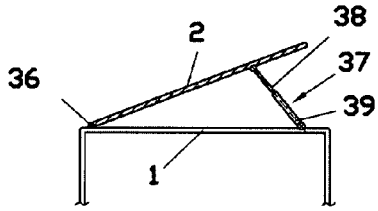
FIG. 4 is an orthogonal view that shows one of the possible connections between the plate of the tower mast bottom flange with the mast stand.
Figure 5:
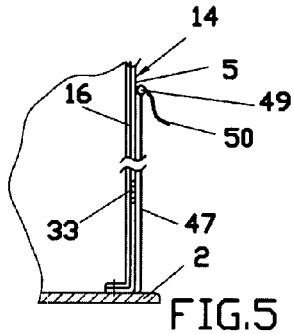
FIG. 5 is an orthogonal view that shows the lower section of the tower mast, a detail of one of the variations of the lower section of the tower mast.
Figure 6:
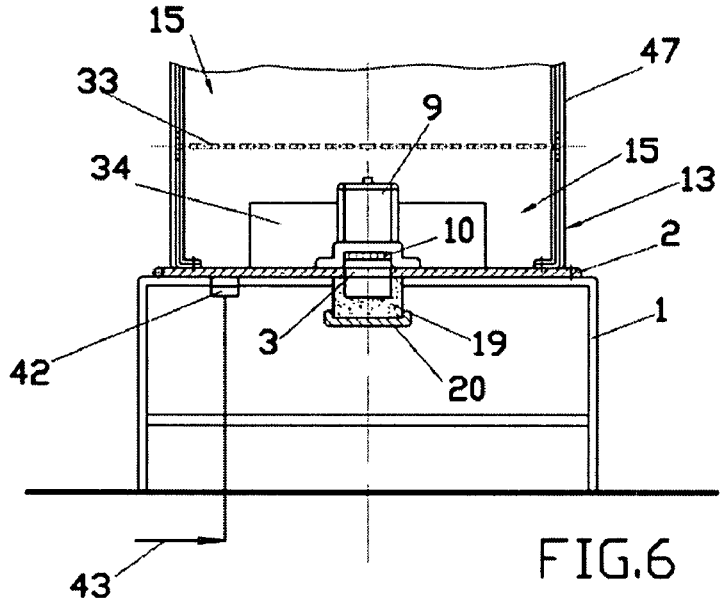
FIG. 6 is an orthogonal view that shows a light tower arrangement scheme with the electric motor mounted on the top surface of the flange plate and connected to the electricity mains line.
Figure 7:
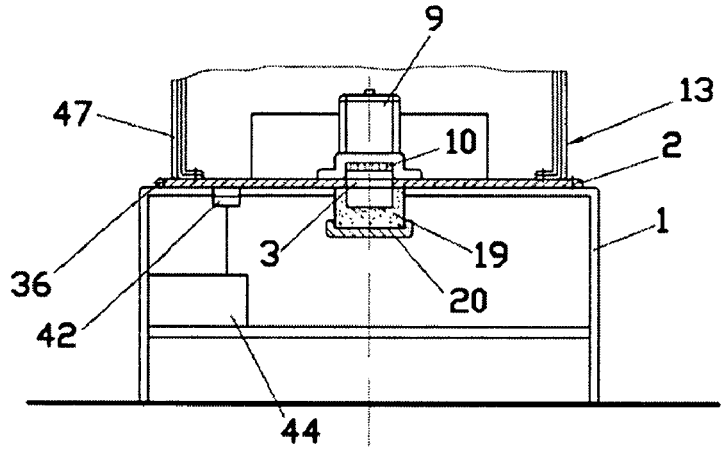
FIG. 7 is an orthogonal view that shows a light tower arrangement scheme with the electric motor mounted on the top surface of the flange plate and an autonomous power source for the electric lamp powered from a rechargeable battery.
Figure 8:
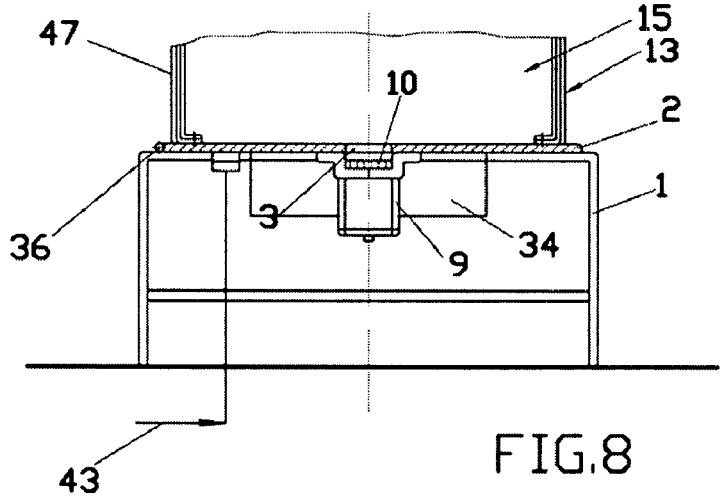
FIG. 8 is an orthogonal view that shows a light tower arrangement scheme with the electric motor mounted on the bottom surface of the flange plate and connected to the electricity mains line.

The plate (2) is mounted on the stand (1) in a way that makes it possible to quickly dismount it from the stand or turn it around a pivot (36) (FIGS. 1, 4, 13) that connects one side of the plate (2) with the stand (1), and fix the plate (2) in an inclined position by means of a fixing means (37) (FIG. 4). The latter means may be made of telescopically connected elements (38) and (39), whose ends have common hinged joints with the plate (2) and tower stand (1).

Figure 3:
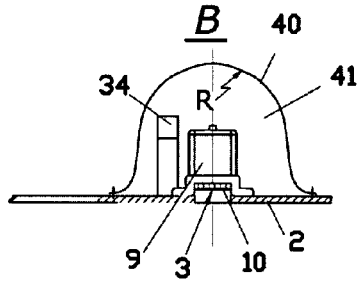
FIG. 3 is an orthogonal view that shows view B of FIG. 1.

In this particular tower arrangement, the electric motor and control unit are protected from the additional shell (16) of the diaphragm (12) by mounting the control unit (34), electric motor (9), and air pump (10) inside a hemi-cylindrical housing (40), which is also mounted on the plate (2) of the bottom flange (FIGS. 1, 3). Apart from its protective function, the housing (40) also particularly forms an air duct (41), which cools down the electric motor (9), control unit (34), and air pump (10) during the operation of the light tower. The air duct (41) formed by the housing (40) and the plate (2) connects with the air chamber (35) of the diaphragm (12) and through an opening (28) of the neck (26) of the diaphragm (12) with the air chamber (7) of the upper section (14) of the tower mast (4).

The housing (40) is rigid, made of a thin rigid sheet. When mounted on the plate, the sheet forms the hemi-cylinder of the housing. The longitudinal ends of the housing are located in the fastening elements or guides mounted on the plate (2).

The light tower in the particular arrangement described is equipped with an electricity supply device (42) supplying electricity to the control unit (34) (the device and/or unit are illustrated in FIGS. 6-11). The device (42) is a connector with wires designed to connect the power source with the control unit (34). In this tower arrangement, the electricity supply device (42) is mounted underneath the plate (2) on the outside.

In a first basic and general tower arrangement (FIG. 6), the air pump (10), electric motor (9) and control unit (34) are mounted on the flange plate (2). The said tower components may be mounted inside the internal chamber (15) of the shell of the lower section (13) of the mast (4). (When the lock (33) has an airtight design, this rules out the use of the diaphragm (12) (FIG. 1), which is why there is no air chamber (35) for the diaphragm (12), in which the driving elements of the tower would be mounted in this particular tower arrangement). In this variation (FIG. 6) of the tower arrangement, the electricity supply device (42) is mounted on the outside underneath the flange plate (2); the motor (9) driving the air pump (10) is electrical; and the electricity supply device is connected to a remote power source, such as an electricity mains line (43).

In a second variation of the light tower arrangement (FIG. 7), the air pump (10), electric motor (9), and control unit (34) are mounted on the top side of the flange plate (2) inside the internal chamber (15) of the lower section (13) of the mast (4); the electricity supply device (42) is mounted on the external bottom side of the flange plate (2); the motor (9) is electrical; and the electricity supply device (42) is connected to an autonomous power source mounted on the stand (1), for example, a rechargeable battery (44).

In a third variation of the tower arrangement (FIG. 8), the air pump (10), motor (9), control unit (34), and electricity supply device (42) are mounted on the external bottom side of the flange plate (2); the motor (9) is electrical; and the electricity supply device (42) is connected to a remote power source, such as the electricity mains line (43).

In a fourth variation of the tower arrangement (FIG. 9), the air pump (10), motor, control unit (34), and electricity supply device (42) are mounted on the external bottom side of the flange plate (2); the motor is an internal combustion engine (45), and the electricity supply device is connected to an autonomous power source, such as a generator (46) coupled with the internal combustion engine. In this variation, the air pump (10) is coupled with the generator (46). Specifically, the impeller or ventilator of the air pump (10) is mounted on the generator (46) shaft. In this variation of the tower arrangement an electric motor is no longer necessary.

In a fifth variation of the tower arrangement (FIG. 10), the air pump (10), electric motor (9), control unit (34), and electricity supply device (42) are mounted on the internal bottom side of the flange plate (2) outside of the mast shell chamber; the autonomous source of power is a rechargeable battery (44) connected to the electric lamp (8) with the electricity supply device (42).

In a sixth variation of the tower arrangement (FIG. 11), the air pump (10), motor, control unit (34), and electricity supply device (42) are mounted on the internal bottom side of the flange plate (2) outside of the shell chamber of the bottom section (13) of the mast (4). The motor is an internal combustion engine, and the electricity supply device (42) is connected to an autonomous power source, such as a rechargeable battery (44) mounted on the stand (1).

All variations of tower arrangements include the housing (47) located in the bottom section of the mast (4) as shown in FIGS. 1, 5, 12, 15. The housing (47) is a cylindrical flexible shell whose one end is rigidly mounted onto the bottom flange plate (2) and a second free end (48) of the housing (FIG. 15) is located around and along the lower and upper sections (13) and (14) of the mast (4). The free end (48) of the housing (47) has an opening (49) along the housing perimeter containing a string (50) (FIGS. 1, 5), which girds the mast (4) along its transverse perimeter. The housing (47) contains all tower components above the flange plate (2) of the tower mast when the tower is collapsed for transportation. If necessary, when the tower is in the operating position, the ends of the string (50) may be fastened to further tighten the housing (47) around the external surfaces of the lower and upper sections (13) and (14) of the tower mast (4).

Description of a First Independent Variation of the Tower Mast

Figure 13:
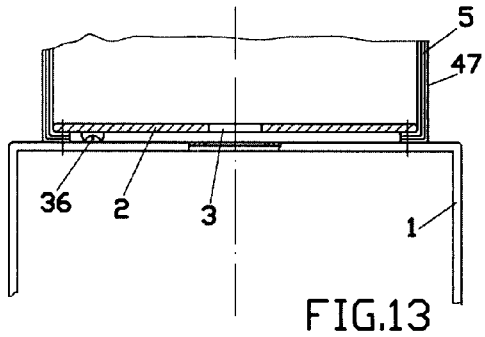
FIG. 13 is an orthogonal view that shows one of the preferred variations of the connection of the flange plate, with the tower mast and stand.
Figure 14:
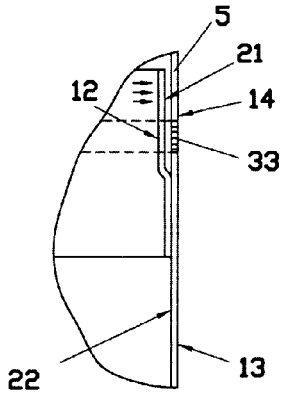
FIG. 14 is an orthogonal view that shows a variation of the sealing means that hermetically seals the coupling of the mast sections or the upper section of the mast with the detachable main section; the sealing means is located on the inside of the mast.
Figure 15:
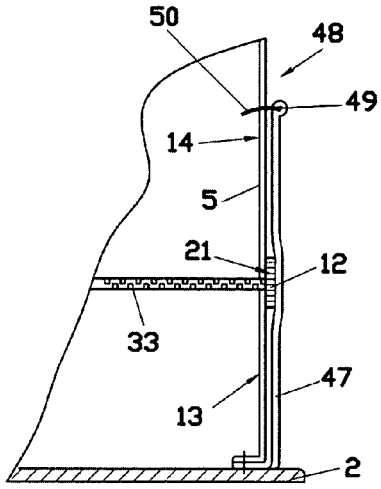
FIG. 15 is an orthogonal view that shows a possible variation of the sealing means that hermetically seals the coupling of the lower and upper sections of the mast; the sealing means is located on the outside of the mast.
Figure 16:
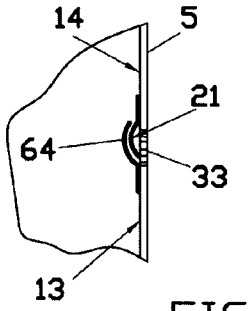
FIG. 16 is an orthogonal view that shows a possible variation of the sealing means that hermetically seals the coupling of the upper and lower sections or the coupling of the upper mast section with the detachable main section; the sealing means is located inside the mast and is designed as a single whole with the lock.

The mast (4) (FIG. 12) of the light tower is an upwardly elongated and air-inflated cylindrical structure made of a transparent and flexible airtight shell with a thin wall (5). A bottom end (51) of the mast (4) shell is hermetically coupled onto the plate (2) with fastening elements (52) or may be coupled onto the plate as shown in FIG. 13. As was mentioned previously, the flange, upon which the mast shell (4) is mounted, comprises the plate (2), elements (52) for coupling the mast shell to the plate, as well as fastening elements for the housing, motor, and control unit (not shown). In the particular tower arrangement, the air vent (3) of the plate (2) is located in the center of the plate (2) and serves to inflate the shell chamber (7) with air under pressure.

Figure 17:
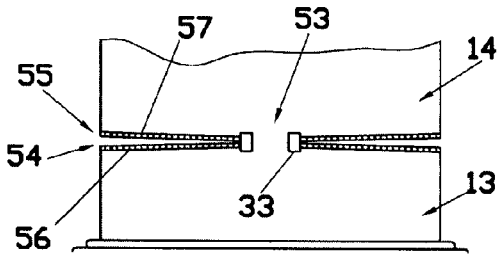
FIG. 17 is an orthogonal view that shows the lower and upper sections of the mast with the lock and coupling, a variation of the coupling of the mast sections.
Figure 18:
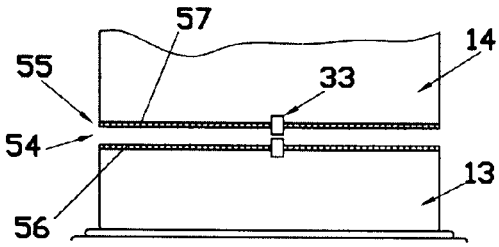
FIG. 18 is an orthogonal view that shows the lower and upper sections of the mast with the lock or the upper section and the detachable main section of the mast in a pre-installation position, scheme.

In the first variation of the tower arrangement, the bottom end of the mast shell (4) along its perimeter is made of two coupling links (53) (FIG. 17) capable to join lower and upper sections (13) and (14); the connecting ends (54) and (55) of their respective mast shell sections (13) and (14) include detachable coupling mechanisms (56) and (57). The detachable coupling is a rapid-action lock (33) (FIGS. 12, 14-18), which is formed by the coupling mechanisms (56) and (57).

The lock will be selected from among known locks that meet the strength requirement for the coupling. In different variations of the coupling of the sections (13) and (14) various sealing mechanisms are used, including mechanisms that may be structurally connected with the lock or be made as a single whole with the lock. The main requirement for the coupling of the sections (13) and (14) of the mast (4) is its strength and air-tightness that would rule out air leaks from the mast (4) chamber into the atmosphere through the lock (33).

Figure 19:
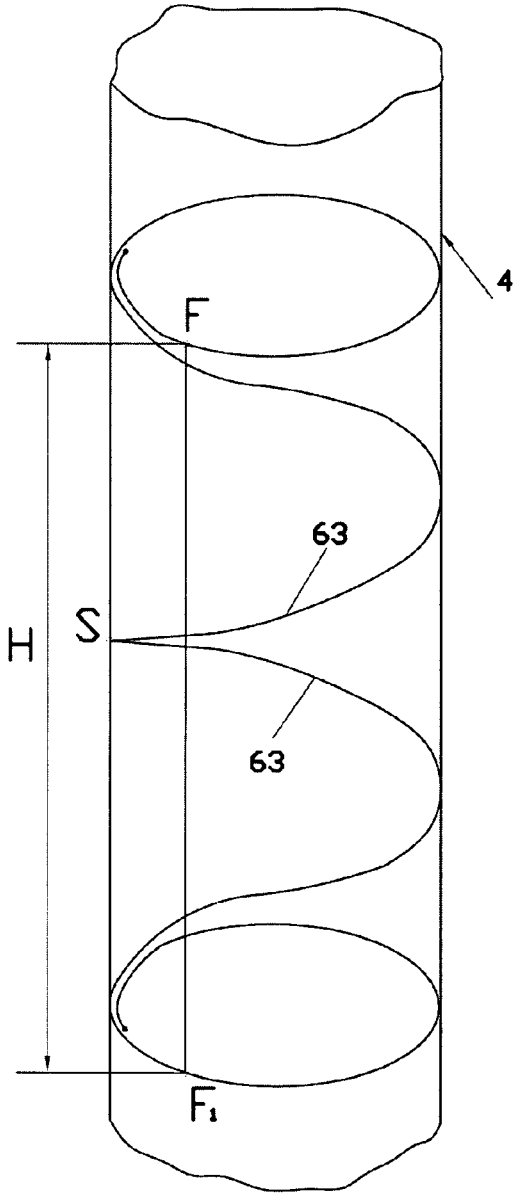
FIG. 19 is a schematic view that shows a scheme of arrangement of parts of the lock of the retractor of the upper section of the mast.
Figure 20:
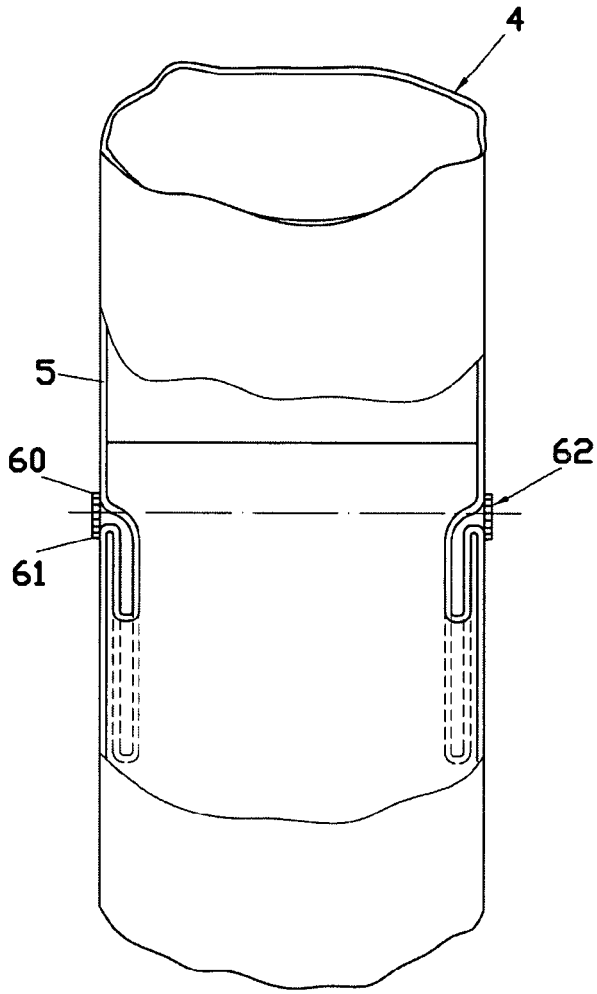
FIG. 20 is a schematic view that shows a scheme of the wall of the upper section of the mast in its retracted position.
Figure 21:
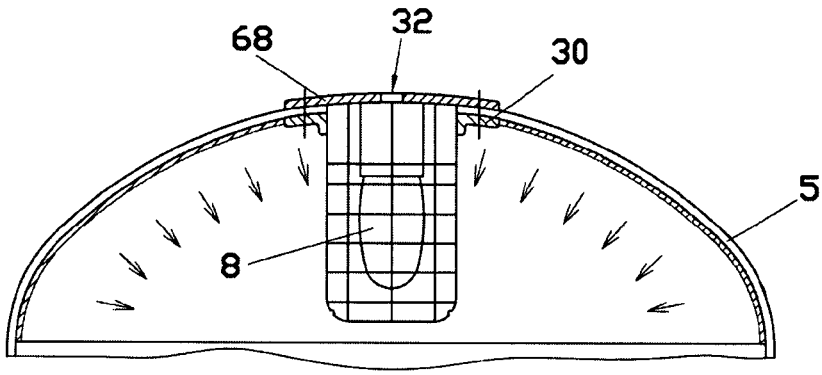
FIG. 21 is an orthogonal view that shows the upper section of the mast, a fragment of the second variation of the mast—the top flange is connected to the appliance holding the electric lamp.

A retractor (59) of the upper section (14) of the mast is attached to the external surface (58) (FIG. 12) of the upper section (14) of the wall (5) that forms the shell of the mast (4). (The upper section (14) of the mast is retracted when the mast has been deflated and placed horizontally). The refractor (59) comprises two connected counterparts (60) and (61) of another rapid-action lock (62), which extend to both ends of the mast (4) along helix lines. When the upper section (14) of the mast (4) (FIG. 20) is refracted. the counterparts (60) and (61) of the lock (62) are aligned along their entire length. When the upper section (14) of The mast (FIG. 12) is extended, the counterparts (60) and (61) of the lock (62) are mutually disengaged, fixed on the surface (58). and located along two helix lines (63) (FIG. 19), which extend from their point of intersection (S), which is also located on The external surface (58) of the upper section (14) of the mast (4). The locks (33) and the retractor (59) thus represent a means for extension or a means for charging the length of the mast (4).

The step of one counterpart along one helix line (63) is equal to the step of the other counterpart along the other helix line, and both the lines have an identical shape. As far away from each other as possible, the points F and Fl on the helix lines within the same plane are located at a distance H from each other, which shows the possible distance by which the mast (4) height may be retracted to a position where the counterparts (60) and (61) of the lock (62) are aligned along their entire length. When the upper section (14) of the mast (4) is extended, the counterparts (60) and (61) of the rapid-action lock are clear of each other along their entire length.

In the first variation of the mast (4) (FIG. 1), the lock (33) is sealed with the help of the air-inflated diaphragm (12), made of an additional flexible airtight shell (16) located inside the mast shell (4). The external surface (21) of the shell (16) comes into contact hermetically with the internal surfaces (22) and (23) of the upper and lower sections (13) and (14), respectively.

The most preferable way to seal the coupling of the sections (13) and (14) is to use the rapid-action airtight lock (33) whose design includes a sealing mechanism, thereby ensuring the air-tightness of the coupling of the sections (13) and (14) of the tower mast without any additional means. (These sealing mechanisms of the lock are not described in this disclosure).

Within the tower mast design, the diaphragm for sealing the coupling (FIG. 16) can be made of two flexible and elastic elements (64) located on both sides of a lock coupling or lock (33) and overlapping each other. The flexible elements (54) are located in the shells of the upper and lower sections (13) and (14) of the mast (4). In the second variation of their arrangement, the flexible and elastic elements (64) can overlap each other to ensure an airtight coupling.

The lock (33) can be also sealed with another diaphragm (12) (FIG. 14) made of a flexible film located along the perimeter of the mast (4) and protecting the lock from air pressure inside the mast. The film of such a diaphragm (12) is attached to the inside surface (23) of the lower section (13) of the mast. The lock (33) can be also sealed with the help of a third diaphragm (12) (FIG. 15) made from a soft, resilient, and pliable flexible material. Such a diaphragm is located along the perimeter of the mast and coupled to the inside surface of the housing (47).

In its operating position, the mast (4) (FIG. 1) can be extended by suspension wires (65) extending from the mast, with one end of each suspension wire connected to the mast (4) in its upper section, and the other end coupled to the ground.

In the second arrangement of the mast, the upper section (14) (FIG. 12) of the mast shell (4) includes a detachable main section (66), which serves as the upper section of the tower. Along its transverse perimeter the main section (66) is connected to the upper section (14) of the mast (4) (or to the middle section of the mast shell as a whole), by the second lock (33) located above the first lock (33). The locks (33) are identical and all their working counterparts can be connected with one another. The upper lock (33) is airtight and represents a hermetic detachable coupling of the two mast sections.

Description of a Second Independent Variation of the Tower Mast

Figure 26:
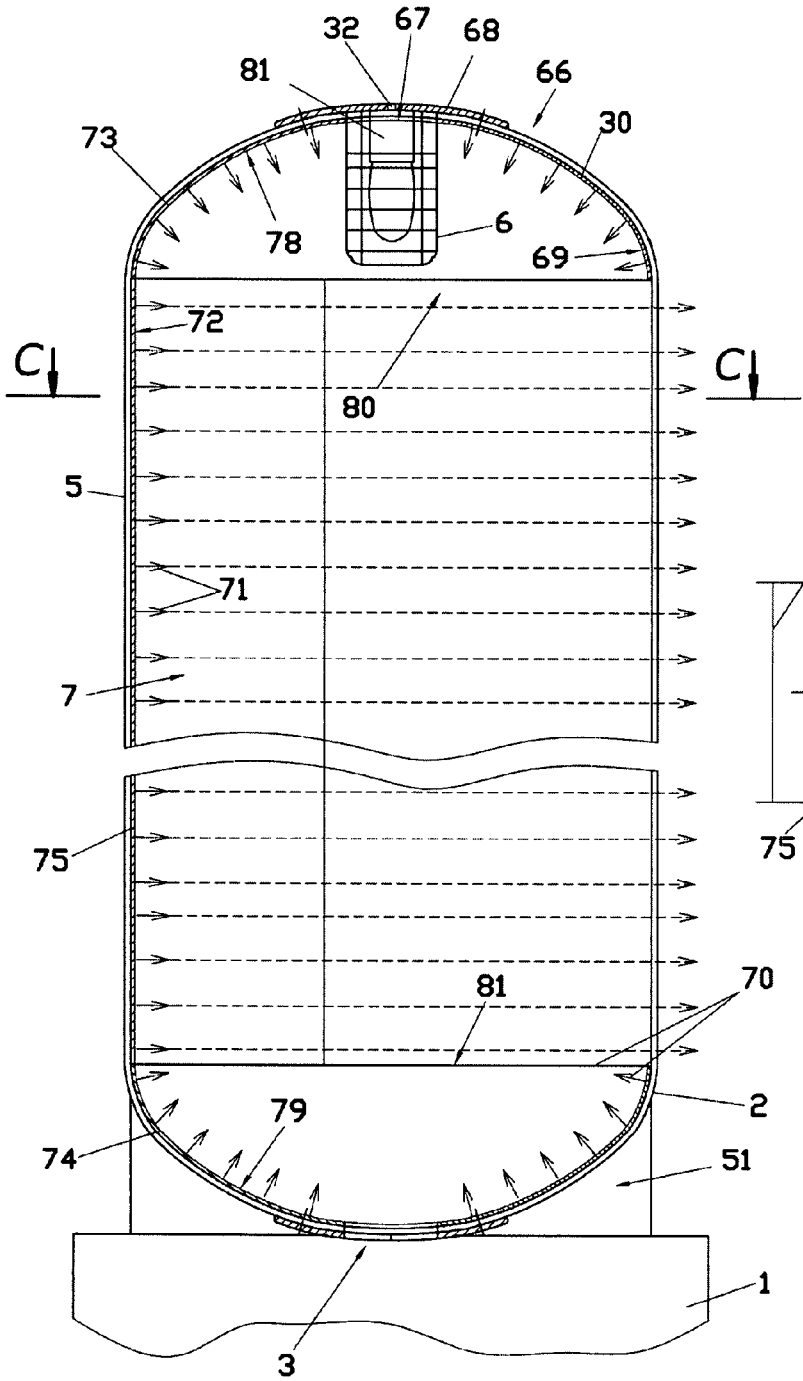
FIG. 26 is an orthogonal view that shows the second independent variation of the light tower mast with the top, bottom and side directional light reflectors.

The principal technical solution of the light tower mast, its second variation, is shown in FIGS. 1 and 26. The mast of the second variation may or may not have all features of the mast described above. Notably, the mast in its second arrangement variation provides improved illumination of space by focusing and directing light rays. The mast of the second variation is also made from an upwardly elongated flexible and transparent airtight shell with a wall (5).

Figure 23:
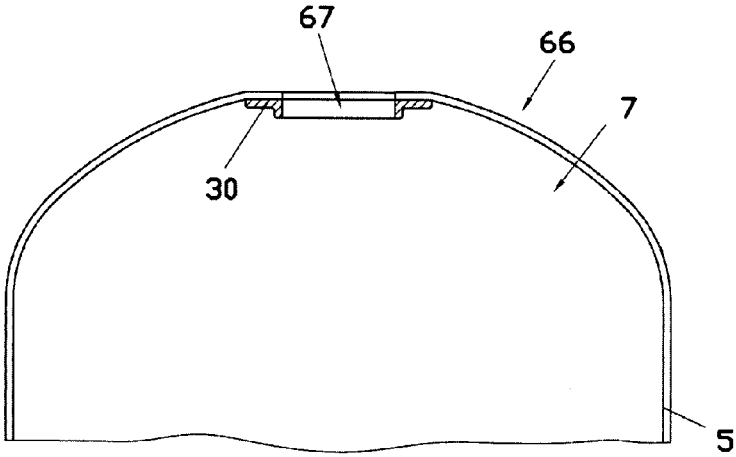
FIG. 23 is an orthogonal view that shows the upper section of the mast with the top flange (the electric lamp and the appliance by means of which it is attached to the top flange have been removed)
Figure 24:
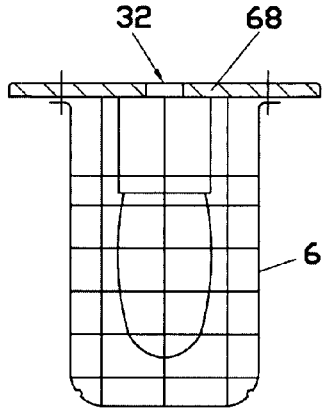
FIG. 24 is an orthogonal view that shows the electric lamp encased in a protective cage along with the appliance by means of which is it attached to the top flange.
Figure 25:
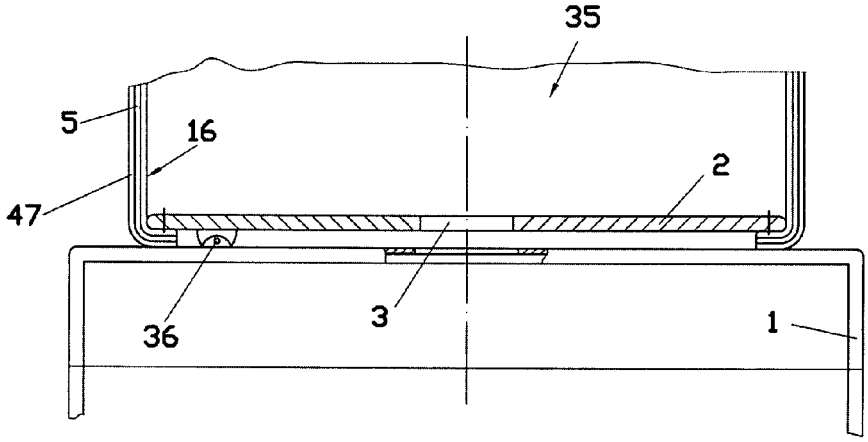
FIG. 25 is an orthogonal view that shows the most preferable variation of attachment of the shell wall, diaphragm and housing to the bottom flange plate of the light tower.

The bottom end (51) (FIG. 12) of the mast shell (4) is hermetically coupled to the bottom flange (2), which has an air vent (3) for inflating the air chamber (7) of the shell with air under pressure. The top end of the shell of the upper section (14) (FIGS. 22-24) of the mast (4) or the main section (66) is hermetically coupled to the upper flange (30), which has a central opening (67) that houses the cage (6) and electric lamp (8), and a holding device bound to the electric lamp (8), specifically an additional flange (68) connected with the top flange of the mast (4).

This holding device for the electric lamp is provided only as an example of practical implementation. But it can be different, meeting the key requirement—fast detachment and effective protection of the electric lamp (8) from mechanical impacts and overheating. The wall (5) of the mast shell is located and fixed between the top flange (30) and the additional flange (68).

The second variation of the mast (4) arrangement (FIGS. 1 and 26) involves making the mast with an upper directional light reflector (69) and at least two additional directional light reflectors, one of which—a bottom light reflector (70)—is located at the bottom of the mast (4), and another additional side light reflector (71) is located along one side (72) of the mast. The upper and lower light reflectors (69) and (70) are directed at the side reflector (71), which is aimed at the remote object of illumination.

Different variations of light reflectors are contemplated.

The light reflectors are performed as light-reflecting coatings (73), (74) and (75). The coating (75) (FIG. 27) covers only one side (76) of the mast on a hemispherical inner surface (77) of the shell wall (5). This hemispherical light-reflecting surface (77) of the said mast side forms the side light reflector (71). The other two light-reflecting coatings (73) and (74) of the top and bottom light reflectors (69) and (70) cover the internal upper and lower surfaces (78) and (79) of the top flange (30) and bottom flange of the plate (2) of the mast (4), respectively.

This second variation of the tower mast arrangement, as well as the first variation of the mast, has the flange of the plate (2) mounted on the stand (1) of the mast. The difference between the first and second variations of the tower mast arrangement is that in the second mast variation its top and bottom flanges are spherical and perform the function of light reflectors in addition to their attachment function.

Figure 27:
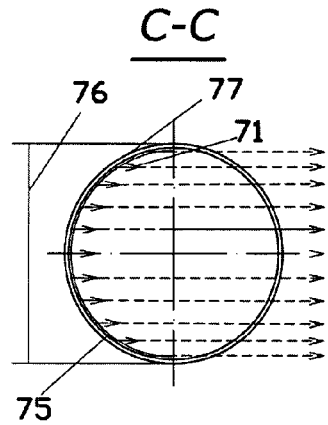
FIG. 27 is an orthogonal view that shows the B-B section in FIG. 26.

If light-reflecting coatings (73), (74) and (75) cover the inside surfaces of the flexible transparent wall (5) (FIG. 1) of the mast (4) shell on three sides, while one side of the mast (right side) is left transparent (without the light-reflecting coating), then the light tower will produce directed illumination as shown in FIG. 27, thereby providing concentrated illumination on sections that require a higher degree of illumination.

The top and bottom flanges (30) and (2) of the mast, which are made in the form of hemispherical cups (80) and (81) (FIG. 26), provide the highest degree of concentration of illumination from the mast, because the hemispheres of the cups (80) and (81) are oriented in such a way that they reflect light from the electric lamp (8) onto the light-reflecting coating (75) of the side light reflector (71). The latter is aimed at the remote object of illumination.

The flanges (30) and (2) may be identical and interchangeable and have identical central openings. At the same time, the opening (3) of the bottom spherical flange of the plate (2) serves as an air vent, while the opening (67) of the top flange (30) houses the entire illumination unit, including the electric lamp (8), its socket (81), and the cage (6), which are part of the attachment means of the electric lamp (8) coupling it to the upper section of the mast (4). In addition, the opening (67) (FIG. 23) of the upper flange (30) or the flange shown in FIG. 26 may be of a size that will allow manual access to the internal air chamber of the mast (4). In this third variation of the mast (4) it can be made without the diaphragm (12) (FIG. 1) or the bottom lock (33). The spherical flange (2) (FIG. 26) is coupled with the stand (1); the top spherical flange (30) is coupled with the additional flange (68) holding the electric lamp.

Description of a Light Tower Control Unit for the Inventive Method

Figures 28, 29:
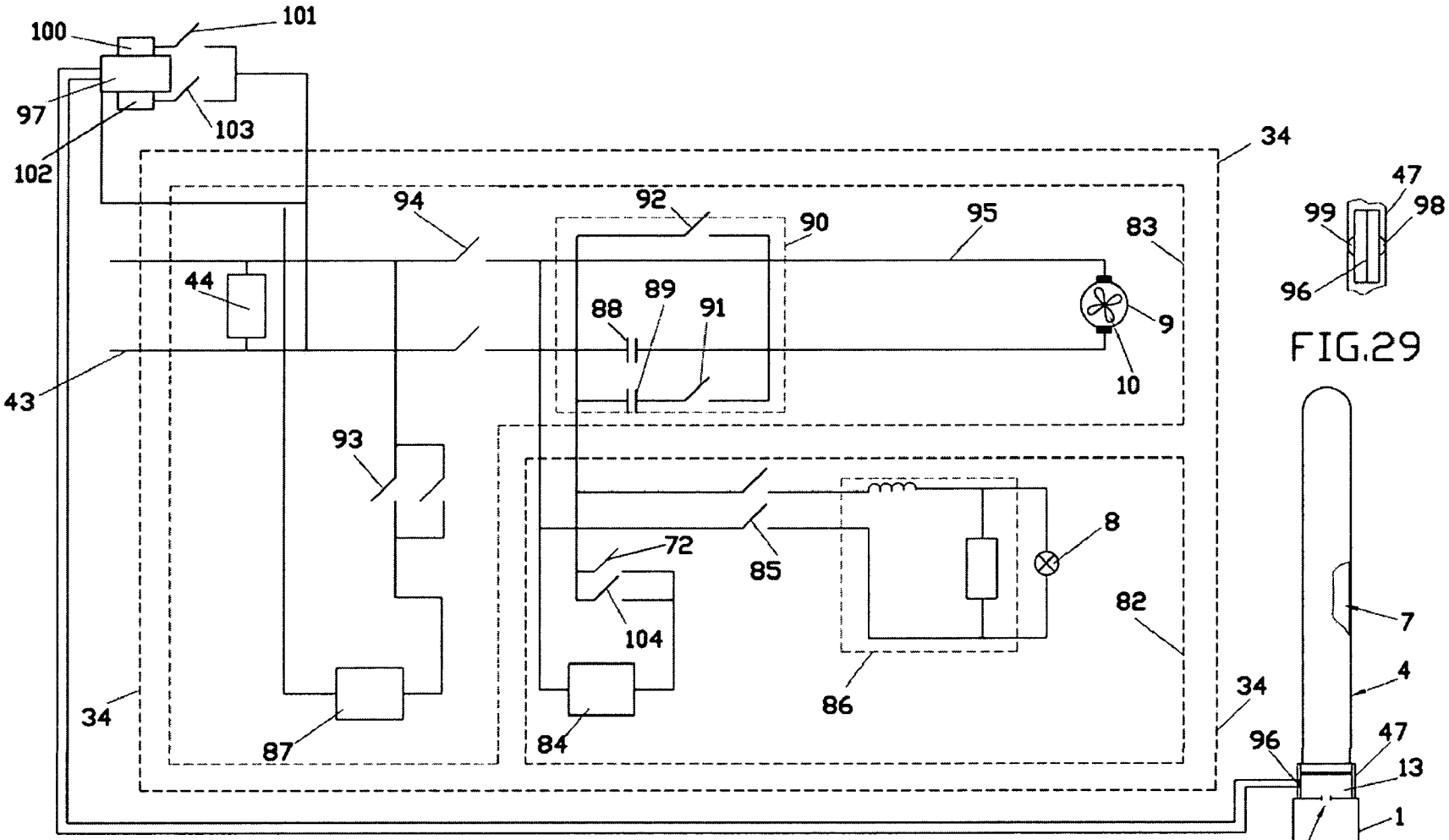
FIG. 28 is an orthogonal view that shows the light tower control unit for method implementation.
FIG. 29 is an orthogonal view that shows the air pressure sensor of the control unit.

The light tower is equipped with a unit (34) (FIG. 28) controlling the tower operation for the inventive method implementation. The unit (34) comprises an electric circuit (82) (FIG. 28) controlling the electric lamp (8) of the light tower and an electric circuit (83) controlling the electric motor (9) of the air pump (10) that inflates the air chamber (7) of the tower mast. The electric circuits are interconnected, and each connected to one of the power sources (43), (44) or (46) (FIGS. 8-11).

The electric lamp control circuit (82) contains a first relay (84) for turning on the electric lamp and a start-and-adjustment device (86) connected with the lamp (8) through the contacts (85) of the first relay (84) for switching on the electric lamp.

The electric motor control circuit (83) comprises a second relay (87) for switching on the electric motor (9), and a first and second parallel-connected capacitors (88) and (89) that are series-connected with the electric motor (9). The unit (34) also has a device (90) controlling the electric motor (9) speed. This device comprises the above-mentioned first and second capacitors (88) and (89) and a permanently closed contact (91) of the first relay connected with the second capacitor (89), and the button (92) for switching on the electric motor for full-capacity operation.

A button (92) is connected with the first and second capacitors (88) and (89). The second relay (87) is connected with the electricity mains line via a motor power-on button (93) and with contacts (94) of the second relay (87). The electric motor control circuit (83) comprises a power-off and tower shutdown button (95), which is connected with the electricity mains line.

To ensure automatic operation of the light tower, the tower control unit comprises a two-way feedback pressure sensor (96) (FIG. 29), which is connected to an additional relay (97). In the control unit (34) arrangement presented, the sensor (96) (FIG. 28) is located between the internal surface of the housing (47) and the external surface of the lower section (13) of the light tower mast (4).

The sensor (96) is attached to one of these two surfaces and has spring-loaded sensitive elements (98) and (99) (FIG. 29), which move relative to the sensor housing depending on the air pressure in the air chamber (7) of the mast (4). With one of its sides and one of its sensitive elements (98) the sensor interacts with the external surface of the lower section (13) of the tower mast (4), and with the other side and sensitive element (99) the sensor interacts with the inside surfaces of the mast (4) housing (47). The sensor (96) has a minimum mode relay (100) with a contact (101) and a maximum mode relay (102) with a contact (103), which are part of the additional relay (97) and are connected with the electricity supply line of the electric motor (9). The control unit (34) also includes a power-on button (104) of the electric lamp (8).

Description of the Inventive Light Tower Control Method

The light tower control method involves supplying air under pressure into the air chamber (7) (FIG. 1) of the mast (4)

shell in different operating modes of the air pump (10). The invention contemplates an economical operating mode of the air pump (10) powered by a motor, specifically the electric motor (9). This mode involves optimizing the air supply from the air pump (10) into the air chamber (7) of the mast (4). In this respect, according to the invention, the delivery of air supplied into the air chamber of the mast (4) is divided into three modes.

A first operating mode is short-term and nominal, providing the quick inflation with air pumped into the air chamber (7) of the mast (4) with the air pump (10), when during nighttime rescue operations it is necessary to quickly deploy a light tower.

A second operating mode provides only minimal pumping of air into the already inflated air chamber (7) of the mast (4) to compensate for air leakages through couplings of the tower mast (4) and air cooling down the electric lamp (8) through the ventilation opening (32).

Because the above-mentioned air supply modes are significantly different, as far as the method is concerned this invention requires supplying large quantities of air under high pressure into the air chamber (7) of the mast (4) to install the tower in its operating position, and once the light tower mast (4) has been installed in the operating position, the quantity and pressure of air pumped into the air chamber are reduced to minimum parameters.

As a result, during the operation of the tower, firstly, the mast (4) is relieved of excessive pressure in its air chamber (7), which substantially prevents excessive air leaks, and secondly, this significantly prolongs the service life of the electric motor.

In a third operating mode of the tower, the electric motor (9) and, consequently, the air pump (10) operate at their maximum capacity. This motor and air pump operating mode is required in case of emergency leaks of air from the air chamber (7) of the mast and sudden pressure drops when the shell wall (5) or its couplings are damaged, when it is necessary to either finish work with a damaged mast (4) shell or slowly lower the tower to the ground to avoid damaging the electric lamp.

Significant quantities of air are supplied in the light tower arrangement including the diaphragm (12) (FIG. 1) with its adjustable neck (26). During the operation of this tower mast, air pressure is always higher in the air chamber of the diaphragm (12) as compared to air pressure in the chamber (7) of the upper section (14) of the mast. As a result, the inflated additional shell (16) of the diaphragm (12) acts upon the shell walls of the lower and upper sections (13) and (14) of the mast and through them upon the wall of the housing (47), whereby all of the said walls interact, forming a rigid base in the lower root section of the tower mast (4), which is especially important in difficult conditions of operation when the tower has to resist wind gusts.

Therefore, by increasing the rigidity in the lower root section of the mast, we reduce the quantity of air needed to maintain stability of the mast. Thusly, given all of the method characteristics, a higher air pressure is to be maintained in the lower root section of the mast (4) than in the middle and upper sections of the mast during the operation of the tower.

Operation of the Light Tower

FIG. 1 shows the light tower in its operating condition, but in the transport condition the light tower mast (4) is deflated and is located in the folded position in the housing (47), from where the mast (4) is to be unrolled on the ground into the specified pre-installation position.

Then the electric motor (9) and air pump (10) are turned on. The rotating impeller of the air pump (10) draws air from the atmosphere into the air filter (19), where dirt and dust are removed before air penetrates into the working chamber (11) of the air pump (10). Then air passes through air ducts of the electric motor (not shown) within the electric motor housing, cooling down the housing, and enters the air duct (41) of the housing (40). In the air duct (41), air is separated into left and right air flows, which flow around the elements of the control unit (34), cooling them down, and pass from the air duct (41) into the chamber (35) of the additional shell (16) of the diaphragm (12).

As a result of continued and constant pumping of air into the chamber (35) of the diaphragm (12) and into the chamber (7) of the mast (4), air is first pumped into the chamber (35) and inflates the chamber (35) of the diaphragm (12), expanding it sideward and upward. Then air is pumped into the chamber (7) of the mast (4). Once sufficient air pressure has been created in the chamber (35), this pressure is applied to the external surface (21) of the additional shell (16) onto internal surfaces (23) and (22) of the lower and upper sections (13) and (14) of the mast whose walls also expand sideward and press with their external surfaces onto the internal surface of the housing (47) walls, expanding them sideward.

The pressure thus created in the air chamber (35) causes interaction and friction among the external surface of the additional shell (16), the internal surfaces (22) and (23) of the lower and upper sections of the mast (4), and the internal surface of the housing (47). As a result, the housing wall, walls of the upper and lower sections of the mast, and the wall of the additional shell of the mast connect with one another, and the force of friction among them forms a rigid wall for the mast in its bottom part, which possesses the necessary increased rigidity and stability in this section as compared to the lower rigidity of the upper section (14) of the mast (4).

Simultaneously with the described process of the chamber inflation, air under pressure moves through the opening (28) in the neck (26) of the diaphragm (12) from the chamber (35) of the additional shell (16) into the air chamber (7) of the upper section (14) of the mast, causing it to extend, inflate, and rise upwards, becoming rigid and lifting the electric lamp (8) with the cage (6) and flanges to a predetermined height (from three to five or more meters).

Simultaneously with the tower mast extending into its operating position, the lock (33) is sealed when the surface (21) of the additional shell (16) opposite the lock (33) presses against the lock (33) and adjoining surfaces (23) and (22) of the lower and upper sections (13) and (14) of the mast under the rising air pressure. The surface (21) of the diaphragm (12) closes micro gaps in the lock (33), substantially preventing air leaks from the air chamber of the mast (4) into the atmosphere through the lock (33).

In other variations of the tower mast (4) arrangement, air leaks through the lock (33) are prevented when the diaphragm (12) surface (21) (FIG. 14) formed by a film, or the diaphragm (12) surface (21) (FIG. 15) formed by the resilient material of this diaphragm, or the surface of flexible elements (64) (FIG. 16) acting as the diaphragm, press against the lock (33) under pressure in the chamber (35), thereby closing the micro gaps in the lock.

As air is pumped into the air chamber (7) (FIG. 1), the upper section (14) of the mast (4) is extended and suspension wires (29) are installed into their operating position. Where the suspension wires are resilient and tending to fold in the longitudinal direction, the suspension wires are extended under air pressure in the chamber (7).

In the case of resilient suspension wires that tend to extend, such wires keep the wall (5) of the mast shell (4) in the upper section (14) apart from the lamp when air is pumped into the air chamber (7) of the mast. In this case, when the tower mast collapses while being retracted, creating the risk of the electric lamp (8) crashing onto the ground, the resilient suspension wires (29) that tend to extend in the longitudinal direction act as shock absorbers when the upper section (14) of the mast (4) hits the ground. [00] Due to the suspension wires (29), the operating position of the electric lamp (8) and its protective cage (6) is stabilized relative to the central longitudinal axis of the mast, which substantially prevents contact between the electric lamp (8) and the mast shell (4) and heat damage to the mast shell.

Once the mast has been installed in its operating position, air supply into the air chamber (35) of the additional shell and the air chamber (7) of the upper section (14) of the mast is significantly reduced, and the free ends of suspension wires (65) are attached to the ground, further stabilizing the operating position of the tower.

A reduction in the quantity of air pumped into the mast is necessitated by the fact that, as has been proven, lower quantities of air and lower air pressure in the mast significantly reduce air losses through micro cracks in the mast and micro gaps in the mast couplings. Notably, a pressure reduction in the mast reduces the size and number of cracks as a result of the physical properties of the elastic material from which the mast shell is made. If a pressure reduction in the mast causes all micro gaps in mast couplings to close, air leaks through mast couplings stop altogether. This substantially eliminates the need to pump large quantities of air into the mast.

The electric motor (8) and air pump (10) can be switched into the minimum operating mode with regard to air pumping (with the air pump working at minimum capacity) by means of the tower control unit (34), whose operation is described below.

After the electric lamp (8) is switched on, air surrounding the lamp (8) in the upper section of the mast starts to heat up, while air constantly pumped by the air pump (10) flows upward into the air chamber (7) of the upper section of the mast (4) and around the electric lamp (8), cooling it down, and leaves the mast through the air vent (32) in the upper flange (30).

When it is necessary to retract the light tower, the electric lamp (8) and air pump (10) are switched off. This causes air pressure to drop in the chamber of the mast (4), and the mast will collapse into a horizontal position. If the mast collapses quickly, the suspension wires (29) protect the electric lamp from crashing onto the ground.

If necessary, the length of the mast (4) may be reduced when it is in its horizontal position. To this end, the arms (60) and (61) of the rapid-action lock (62) are brought together along their entire length, thereby reducing the length of the mast (4), after which the process of expanding the mast into its working position as described above can be repeated. As a result, the mast (4) is installed in the vertical position, and the wall (5) of the upper section (14) of the mast occupies the position shown in FIG. 20.

When the height of the tower mast (4) is reduced, it can be used under different conditions. Such conditions include spaces of limited height, spaces that need limited illumination, and in cases of strong wind gusts, which make it impossible to use a fully extended mast. When it is necessary to use the tower with a fully extended mast, the tower is again placed horizontally, and the procedure of reducing the mast (4) length described above is performed in the reverse order.

The light tower can be placed into a transportable position as follows. Once the mast (4) has been placed horizontally, its lower and upper sections (13) and (14) together with the electric lamp (8) and cage (6) are placed in the housing (47), which is then closed by fastening and tying the string (50). Maintenance of the light tower, in particular its electric motor (9), air pump (10), and control unit (34) is to be performed when the mast (4) is deflated and placed horizontally. To this end, the lock (33) is opened and moved apart the lower and upper sections (13) and (14) of the mast far enough to enable access to the said tower units.

Then the resilient housing (40) (FIG. 3) should be opened and removed by compressing it and moving one of its longitudinal parts or both parts towards the central axis of the housing. At this point, the part compressed to the inside of the housing disengages from the element fastening the housing to the plate (2), and the housing opens and can be removed. Thereafter, all the necessary repairs or routine maintenance on the above said tower units can be carried out. At the same time, the upper and lower sections (13) and (14) of the mast (4) remain coupled (FIG. 17) and are constantly maintained in a predetermined position relative to each other by means of a coupling link (53).

It is worth noting that when the upper and lower sections (13) and (14) of the mast (4) are moved relative to each other after their disengagement, the coupling link (53) prevents the lock (33) from moving relative to the ends of this lock's counterparts and relative to sections (13) and (14). Due to such connection of sections (13) and (14) by means of the coupling link (53) and stable location of the lock (33) on the coupling link (53), the lock is always in a position of readiness for rapid action relative to the mast sections, which enables quick servicing of the tower units and ease of maintenance.

After performing the necessary maintenance work the housing (40) should be closed. If the mast (4) (FIG. 12) has the main detachable section (66) (FIG. 12) in its upper section (14), then, upon the reduction or increase of the mast (4) length, the upper lock (33) can be connected with the lower lock (33), whereby the main section will be connected with the lower section (13) of the mast (4). In this case the upper section is removed from the mast (4). In the second variation of mast length adjustment, when the counterpart (61) (FIG. 12) of the lock (59) is an extension of the lower counterpart (56) (FIG. 18) of the lower section (13) of the mast, then the length of the mast can be adjusted by connecting the lower lock (33) with the lock (59), giving the single length of the mast (4).

If the counterpart (60) (FIG. 12) of the lock (59) is an extension of the upper counterpart of the lock (33) (similarly to the variation with the lower lock (33) described), then the second length of the mast (4) is obtained upon connecting the counterpart (60) with the lower counterpart of the upper lock (33). Other combinations of connection of the lock (59) counterparts with the counterparts of the lower and upper locks are possible.

The mast (4) (FIGS. 1, 26) containing the light reflectors (69), (70), and (71), provides directed light beams. As a result, the light from the electric lamp (8) is reflected off the light reflectors and directed where focused illumination is required.

Operation of the Control Unit

The button (93) (FIG. 28) is pressed to switch on the electric motor. The second relay (87) switching on the electric motor is actuated, and the contacts (94) of the second relay become connected, switching on the electric motor (9).

At the same time, the button (93) becomes blocked. The electric motor operates in the nominal capacity mode at average rotational speed, and the air chamber (7) of the mast (4) is inflated with air. Once the air chamber has been inflated with air up to a certain pressure, the button (104) is pressed for switching on the electric lamp (8).

The relay (84) is actuated, and contacts (85) switch on the electric lamp, while blocking the electric lamp power-on button (104). The permanently locked contact (91) disconnects the second capacitor (89), and the electric motor starts operating at a minimum rotational speed in the mode of minimum pumping of air into the air chamber (7) of the tower mast (4). The light tower is switched off by means of the power-off and tower shutdown button (95).

In the emergency mode (for example, when the tower shell is punctured), to prevent the tower from crashing to the ground, the button (92) is pressed to switch the electric motor to the full-capacity mode, whereby the capacitors (88) and (89) are disconnected and the electric motor (9) starts operating at the maximum rotational speed, powered directly from the electricity mains line. The air pump (10) or impeller coupled with the electric motor will be operating at maximum capacity, and the tower will be maintained in the vertical position, enabling to complete work in this emergency mode or prevent the tower mast from crashing to the ground.

The control unit has an automatic operation mode. After the air chamber (7) of the mast (4) has been inflated up to a certain air pressure, the mast (4) expands sideward, the pressure between the housing (47) (FIG. 29) and the surface of the section (13) of the tower mast (4) increases, triggering the sensitive element (98) of the two-way sensor (96), which actuates the additional air pressure relay (97) (FIG. 28); the relay (100) switching on the minimum operating mode of the electric motor is actuated along with the contact (101), disconnecting the capacitor (89) and causing the electric motor to switch into the minimum mode of pumping air into the air chamber (7) of the mast (4).

In case of the above mentioned emergency mode, when air pressure in the air chamber (7) of the mast (4) drops suddenly, this triggers the sensitive element (99) of the two-way sensor (96), which actuates the additional air pressure relay (97), upon which the maximum operating mode relay (102) and contact (103) are actuated, disconnecting the capacitor (88) and connecting the electric motor directly to the electricity mains line. In this case the electric motor will be operating at maximum rotational speed, the air pump (10) or impeller coupled with the electric motor will operate at maximum capacity, while the additional quantity of air supplied into the air chamber will compensate emergency air leaks.

Once the light tower is switched off and shut down with the help of the button (95), the electric lamp (8) goes off, and the air escapes from the air chamber (7) of the mast (4) into the atmosphere through the bottom air vent (3). At the same time, air pressure in the air chamber (7) of the mast drops, and the mast gradually settles to the ground.

The light tower is used in difficult urban, geographical, and weather conditions where electricity lines may be unavailable. In this regard, with the set of optional components for the base tower model (internal combustion engine, rechargeable battery, main detachable tower section, upper tower section with an appliance for adjusting its height, and light reflectors) the user can easily modify the light tower for use in any conditions.

The arrangement of places for mounting the motor, air pump, and control unit on the lower flange plate depends on the choice of motor type and location of the power source. This also determines the locations where the said tower units are mounted on the tower, whether they are mounted on or under the plate, and the type of fasteners that are used. In the bottom flange plate, such mounting fasteners are a variety of holes made in the plate for various fastening elements corresponding to the arrangement of units on the plate. At the same time, it is worth noting that the tower plate onto which all of its units are mounted has been standardized as far as possible.

Figure 9:
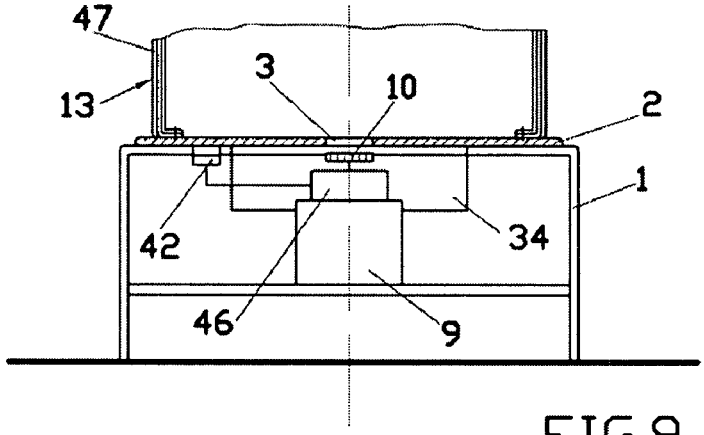
FIG. 9 is an orthogonal view that shows a light tower arrangement scheme with the internal combustion engine mounted on the bottom surface of the flange plate and an autonomous source of power supplied by the generator driven by this engine.
Figure 10:
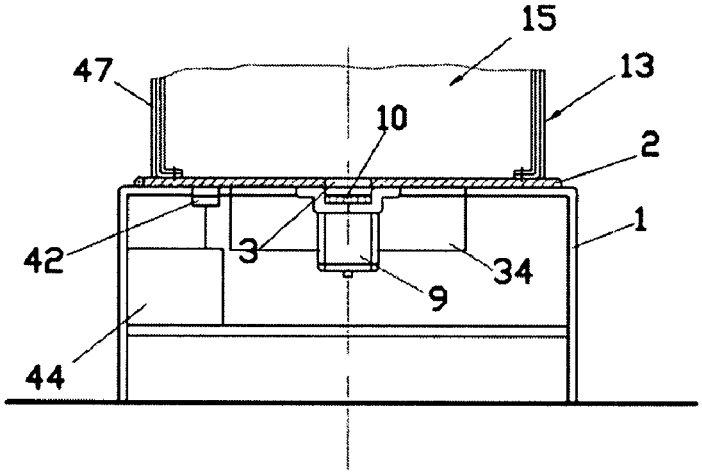
FIG. 10 is an orthogonal view that shows a light tower arrangement scheme with the electric motor mounted on the bottom surface of the flange plate and a rechargeable battery used as an autonomous power source.
Figure 11:
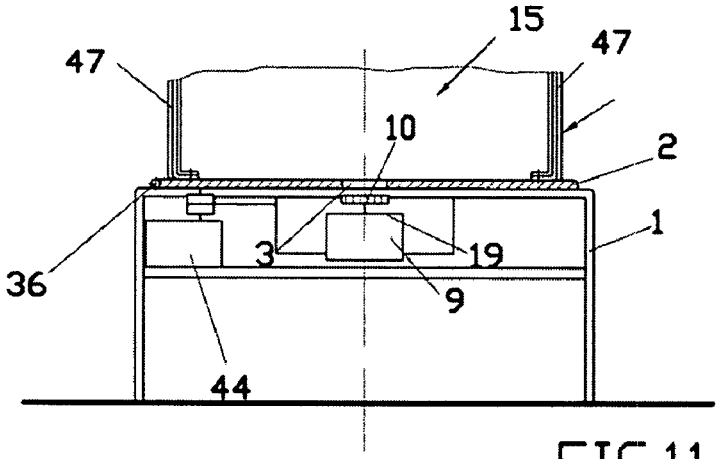
FIG. 11 is an orthogonal view that shows a light tower arrangement scheme with the internal combustion engine mounted on the bottom surface of the flange plate and an autonomous source of power for the electric lamp supplied by a rechargeable battery.
Figure 12:
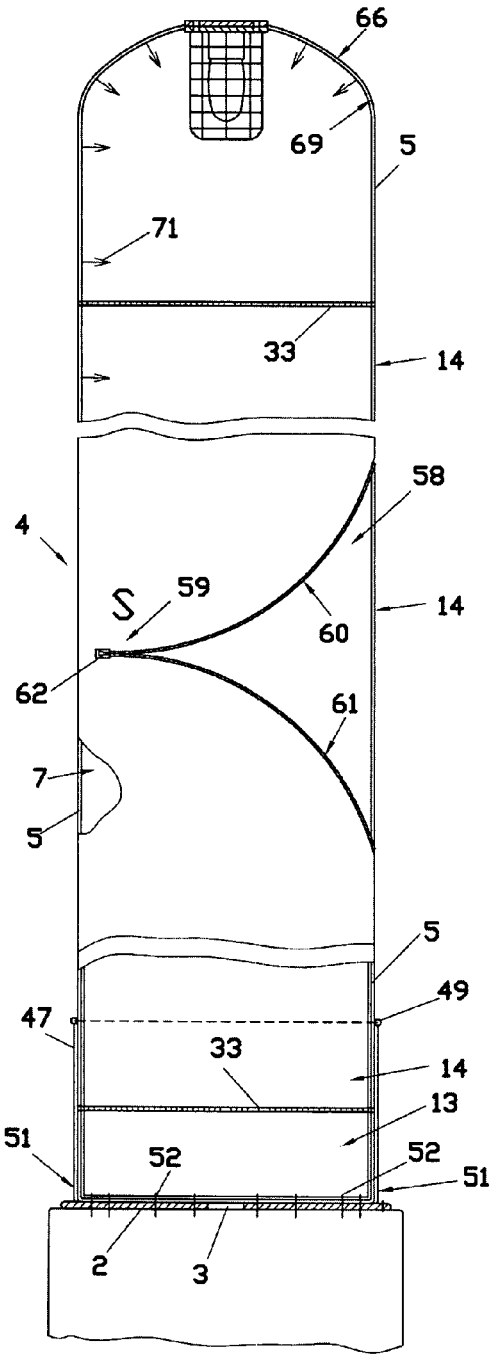
FIG. 12 is an orthogonal view that shows the light tower mast consisting of lower and upper sections; the upper section includes a detachable main section (the first independent variation of the mast—shown in the operating position, under air pressure)

The light tower may also be powered by a generator (46) mounted on the internal combustion engine (45) (FIG. 9). For example, two simultaneously operating light towers may be connected to the same generator (46) of a single internal combustion engine. Or the light tower may have its air pump driven by an electric motor connected to a generator, such as a generator on a car or a different transport vehicle.

The arrangement of the light tower ensures a high degree of standardization of tower components, enabling quick changeover from one tower model to another depending on the conditions where the tower is used, including emergency conditions in the nighttime (collapsed buildings, earthquakes, catastrophes) and other conditions during rescue operations.

SOURCES OF INFORMATION

1. WO 02/44613 A1, 06 Jun. 2002.
2. SU 887879 A, 07 Dec. 1981.
3. RU 2188981 C2, 10 Sep. 2002—control unit prototype.
4. DE 8431698 U1, 19 Jun. 1986.
5. FR 1592981 A, 26 Jun. 1970.
6. WO 01/36065 A1, 25 May 2001.
7. RU 2123874 C1, 27 Dec. 1998.
8. EP 0679413 A1, 02 Nov. 1995.
9. EP 1059483 A2, 02 Nov. 1995.
10. FR 2570049 A, 11 Mar. 1986.
11. U.S. Pat. No. 5,083,250 A, 21 Jan. 1992.
12. U.S. Pat. No. 6,148,551 A, 21 Nov. 2000.
13. WO 03/098097 A1, 27 Nov. 2003.
14. WO 03/088197 A1, 23 Oct. 2003.
15. RU 36486 U1, 11 Nov. 2003.
16. RU 2192581 C1, 10 Nov. 2001—prototype of the light tower, light tower mast, and method of controlling the operation of the light tower mast.
17. WO 99/47853, 23 Sep. 1999 and RU 2000124534 A, 10 Sep. 2002 (convention application)—prototype of the second variation of the light tower mast with light reflectors.

The invention claimed is:

1. A light tower comprising a mast including an upwardly-elongated flexible and transparent airtight shell including a bottom end and an outer surface, said mast having a length;

a flange furnished with an air vent for inflating the shell with compressed air, the bottom end of said shell hermetically fitted onto the flange;

at least one electric lamp disposed and fixed within the shell;

a motor-driven air pump mounted on the flange and connected with the air vent, said pump capable of inflating said shell; and means for changing the length of the mast attached to the outer surface of said shell.

2. The light tower according to claim 1 further comprising:

an electric motor driving said air pump;

power supply means for supplying electricity to at least said electric lamp and said electric motor;

a control unit of the light tower for control of at least said electric motor and said electric lamp; said control unit comprising a first relay for switching on said lamp;

a motor control circuit including:

a start-and-adjustment device connected with said lamp through a contact pair of the first relay;

a second relay for switching on said motor connected to a power-off and tower shutdown button, said power-off button connected to the power supply means;

a first capacitor and a second capacitor connected substantially in parallel to each other, and jointly connected in series with said motor;

a permanently closed contact pair of the first relay, said closed contact pair connected with the second capacitor; and a button for switching on said motor for full-capacity operation, the button connected to the first and second capacitors.

3. The light tower according to claim 2, wherein said control unit further comprising a feedback pressure sensor mounted within said mast shell and electrically connected with said motor control circuit to ensure automatic operation of the light tower.

4. The light tower according to claim 2, wherein said air pump, power supply means, and control unit each disposed either outside said shell, or inside said shell.

5. The light tower according to claim 2, wherein said power supply means connected either to an electrical mains line, or to an autonomous electrical source.

6. The light tower according to claim 5, wherein said autonomous electrical source performed as a rechargeable battery.

7. The light tower according to claim 5, wherein said autonomous electrical source driven by an internal combustion engine.

8. The light tower according to claim 1, wherein said air pump driven by an internal combustion engine.

9. A mast of a light tower, said mast having a length, said mast comprising:

a bottom flange for support of the mast;

an upwardly elongated flexible airtight mast shell including a top region, a lower region, a bottom end hermetically attached to the bottom flange, and a top end; the bottom flange furnished with a vent for inlet of air under pressure into said shell; the shell in the lower region divided into a lower part and an upper part, the lower and upper parts joined with a first airtight coupling means;

means for changing the length of the mast associated with the upper part of said shell;

a top flange associated with the upper part of said shell in the top region, the top end of said shell hermetically attached to the top flange; and an electric lamp substantially mounted onto the top flange.

10. The mast of a light tower according to claim 9 wherein the upper part divided into an upper section and a lower section, said upper and lower sections of the upper part along their cross-section perimeters hermetically jointed with a second airtight coupling means being identical to said first airtight coupling means.

11. The mast of a light tower according to claim 9 wherein said shell having an outer surface, said means for changing the length comprising a rapid-action lock including two detachable coupling counterparts extended to the ends of said mast along helix lines with an equal step, the counterparts connected with their working surfaces in an intersection point on the outer surface of said shell, so that when the length of said shell being extended each counterpart, attached to the outer surface along the helix line, moving further from said point, and when the length being retracted, the counterparts are engaged along their entire lengths.

12. The mast of a light tower according to claim 9 wherein said means for changing the length comprising a rapid-action airtight lock and a sealing means for providing hermetical connection, said sealing means incorporated in the lock.

13. The mast of a light tower according to claim 9 further comprising a coupling link capable of joining the upper and lower parts of said shell, and wherein adjoining parts of said shell being connected with a detachable coupling means including a sealing means for providing hermetical connection thereof.

14. The mast of a light tower according to claim 13 wherein said sealing means is provided in the form of a diaphragm closing said coupling means, and the diaphragm is disposed within said shell.

15. The mast of a light tower according to claim 9 wherein said lower part and said upper part having corresponding inner surfaces;

said diaphragm is provided in the form of an additional flexible airtight shell having an outer surface capable to interact with the inner surfaces of the lower and upper parts of the mast shell; the additional shell including a first end hermetically connected to the bottom flange around said vent and a second free end forming a neck having a cross-section area less than the cross-section area of the mast shell.

16. The mast of a light tower according to claim 14 wherein said diaphragm including two flexible elements disposed within the mast shell along its perimeter on both sides of the coupling means and positioned either as being flush to each other or overlapping each other.

17. A mast of a light tower comprising:

a bottom flange for support of the mast;

an upwardly elongated flexible airtight mast shell including a bottom end, hermetically attached to the bottom flange, and a top end; the bottom flange furnished with a vent for inlet of air under pressure into said shell;

a top flange mounted in the top region of said shell, the top end of said shell hermetically attached to the top flange;

an electric lamp substantially mounted onto the top flange;

an upper light reflector mounted in the top region of said shell;

a lower light reflector mounted in the bottom region of said shell; and a side light reflector mounted in a lateral region of said shell; wherein the upper and lower reflectors are positioned so that they are directed at the side reflector, which is directed at a remote object for illumination.

18. The mast according to claim 17, wherein said side reflector performed as a light-reflecting coating applied to the inner surface of a sidewall of said shell; and said upper and lower reflectors performed as light-reflecting coatings respectively applied to the top and bottom inner surfaces of said shell.

19. The mast according to claim 17, wherein the top and the bottom flanges mounted within said shell and made in a hemi-spherical shape; and said upper and lower reflectors performed as light-reflecting coatings respectively applied to the inner hemi-spherical surfaces of the top flange and the bottom flange.

20. A control method for operation of a light tower comprising the steps of:

providing a mast of the light tower including a flexible shell inflatable with compressed air, said shell divided at least into an upper section and a lower section;

supplying compressed air into said shell at a first predetermined pressure in a first predetermined quantity until the tower installed in its operating position;

supplying compressed air into said shell at a second predetermined pressure in a second predetermined quantity, the second pressure being predeterminedly lower than the first pressure; wherein the pressure of supplied air in the lower section set greater than in the upper section of said shell.

* * * * *